United States Patent [19]

Beller

[11] 4,251,069

[45] Feb. 17, 1981

[54] CHILD RECREATION STRUCTURE

[75] Inventor: Frank W. Beller, Aurora, Ill.

[73] Assignee: Recreation Systems Co., N. Aurora, Ill.

[21] Appl. No.: 19,888

[22] Filed: Mar. 12, 1979

[51] Int. Cl.[3] ..... A63B 17/00

[52] U.S. Cl. ..... 272/113

[58] Field of Search ..... 272/56.5 R, 109–113; D21/244, 245

[56] References Cited

U.S. PATENT DOCUMENTS

| | | | |
|---|---|---|---|
| D. 193,273 | 7/1962 | Kennedy et al. | D21/244 |
| D. 198,532 | 6/1964 | Grudoski | 272/113 X |
| D. 220,505 | 4/1971 | Zick | D21/244 |
| D. 224,243 | 7/1972 | Hock et al. | D21/245 X |
| D. 241,664 | 9/1976 | Ewers et al. | D21/245 X |
| D. 249,080 | 8/1978 | West | D21/244 |
| D. 250,783 | 1/1979 | Dieter et al. | D21/244 |
| 1,126,082 | 1/1915 | Reach | 272/113 X |
| 1,707,854 | 4/1929 | Hanlon | 272/113 X |
| 1,765,361 | 6/1930 | Berman | 272/113 |
| 1,877,833 | 9/1932 | Ferrell | 272/113 |
| 1,901,964 | 3/1933 | Haskell | 272/113 |
| 2,206,581 | 7/1940 | Shapiro | 272/113 |
| 3,572,698 | 3/1971 | Greenly | 272/113 |
| 3,601,397 | 8/1971 | Carlin et al. | 272/113 X |
| 3,730,520 | 5/1973 | Willis | 272/113 X |

FOREIGN PATENT DOCUMENTS

| | | | |
|---|---|---|---|
| 1014182 | 7/1977 | Canada | 272/113 |
| 158566 | 4/1957 | Sweden | 272/113 |
| 290629 | 8/1928 | United Kingdom | 272/113 |
| 1229575 | 4/1971 | United Kingdom | 272/113 |

OTHER PUBLICATIONS

Montgomery Ward, 1970, Summer Sale Catalog; p. 244.

"American Playground Device Co.", Catalog; 1972.

*Primary Examiner*—Richard J. Apley

*Attorney, Agent, or Firm*—Darbo & Vandenburgh

[57] ABSTRACT

A horizontal platform having four or more sides and an exterior vertical sliding pole provides a safe and stimulating challenge to children in a complex recreational structure. The vertical pole is adjacent and spaced from the platform and extends above the platform to offer a means of sliding from the platform. The vertical pole is attached to an arch which extends between and rises above two corner posts which support the platform. A user is allowed access to the platform by one or more ladders integrally built into the structure. An additional slide or arch climber may form part of the structure extending outwardly from the platform at a side opposite the arch. The interrelated complexity and diversity of the structure offer challenge and stimulation to children.

2 Claims, 5 Drawing Figures

CHILD RECREATION STRUCTURE

BACKGROUND AND SUMMARY OF THE INVENTION

This invention relates to recreational structures for children, and more particularly to a complex structure which satisfies a child's natural desire for change and challenge.

For many years, children's playgrounds have been provided with a wide variety of equipment such as swings, slides, merry-go-rounds, monkey bars and the like. However, each piece of equipment promotes only one type of activity, and the limits of a child's notoriously short interest span is quickly reached. Challenges on one piece of equipment are few and quickly satisfied and the equipment thereafter loses its attraction to the child.

The Applicant has found that contemporary equipment has not been used much of the time by children. As noted in U.S. Pat. No. 4,068,842, assigned to the assignee of the present invention, it has been determined that conventional playground equipment does not satisfy the needs of children for mental as well as physical development.

The purpose of the present invention is to provide a new form of apparatus to hold a child's attention and challenge the child to develop new ways in which to utilize the same equipment. A further purpose of the invention is to provide a child recreation structure designed to accommodate children of increasing physical abilities, thereby developing incentive to master the entire structure. Another purpose of the invention is to provide a child recreational structure which, although offering challenge to a multitude of a child's needs, may be part of a recreational system including other child recreation structures, such as that disclosed in U.S. Pat. No. 4,068,842.

The form of the structure and the manner in which the purposes of the invention are achieved will become apparent from the following detailed description of the invention.

DESCRIPTION OF THE DRAWINGS

One form of the invention is shown in the drawings, in which.

DESCRIPTION OF THE PREFERRED EMBODIMENTS

Figure 1:
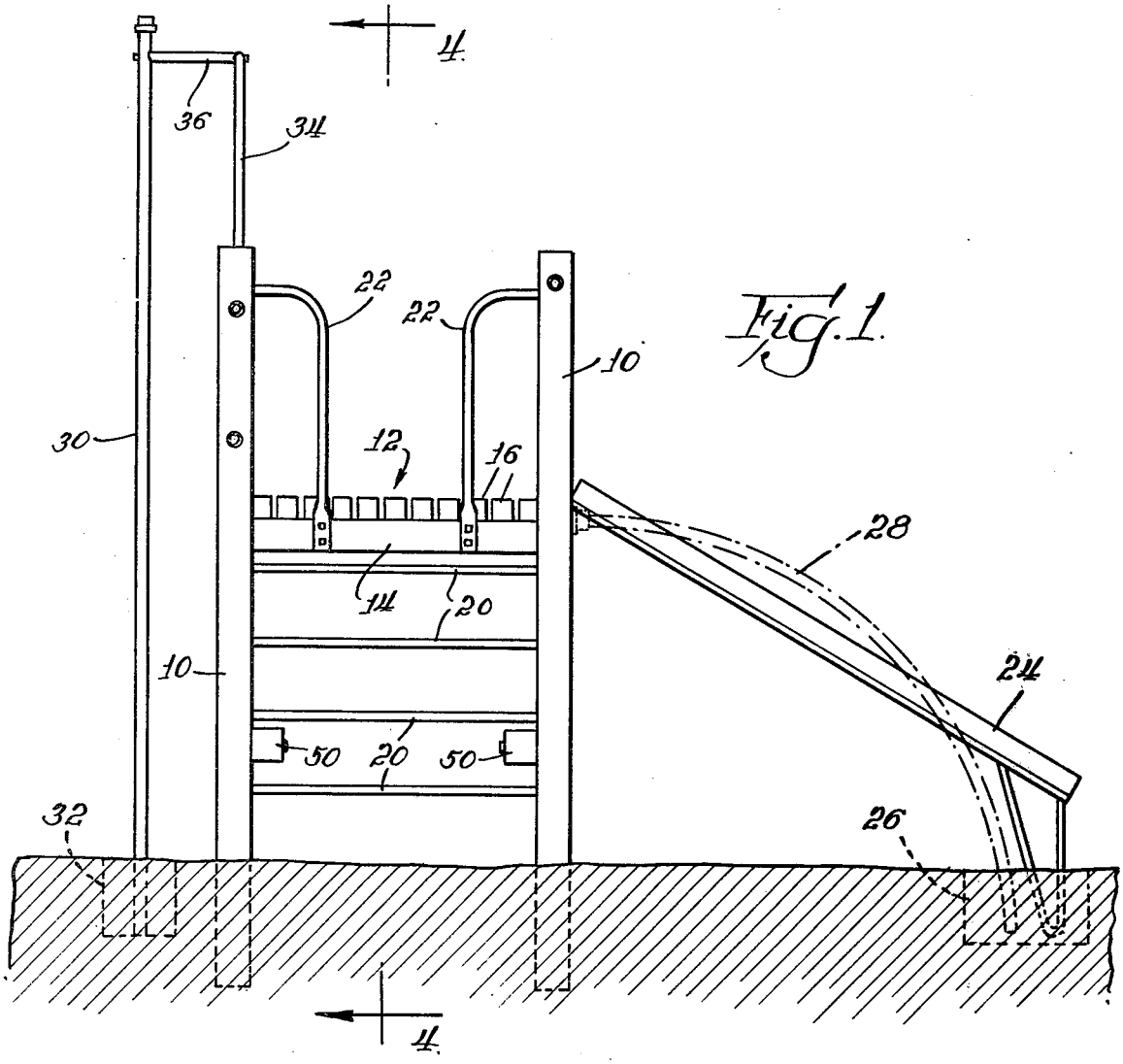
FIG. 1 is a side elevational view of the child recreation structure of the invention, with an alternative embodiment shown in phantom.
Figure 2:
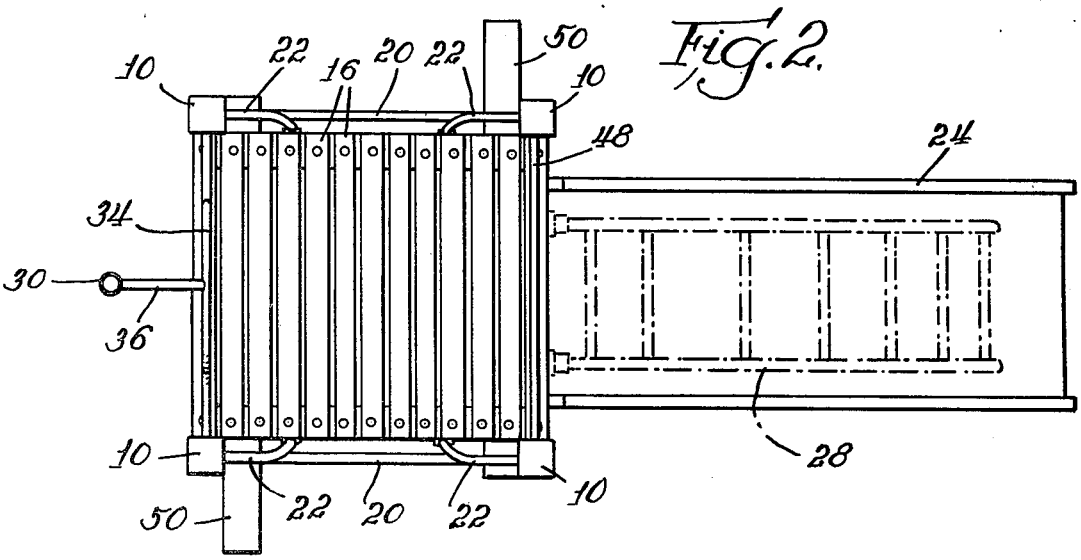
FIG. 2 is a top plan view of the structure of FIG. 1.

The embodiments of the invention shown in the drawing depict a quadrangular structure. While this structure is preferred, other forms may be used, such as a hexagonal plan.

Figure 3:
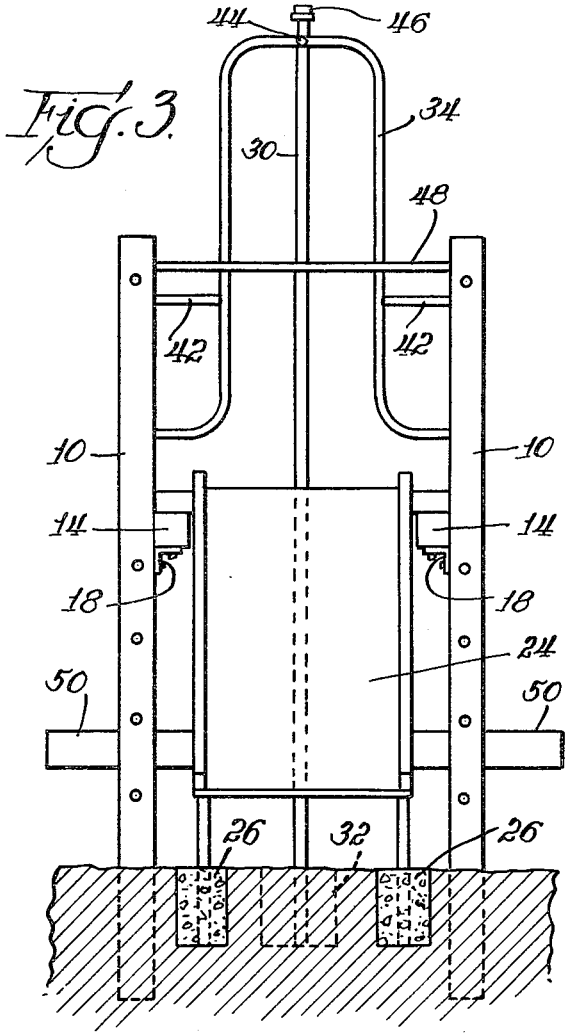
FIG. 3 is a right side view.
Figure 4:
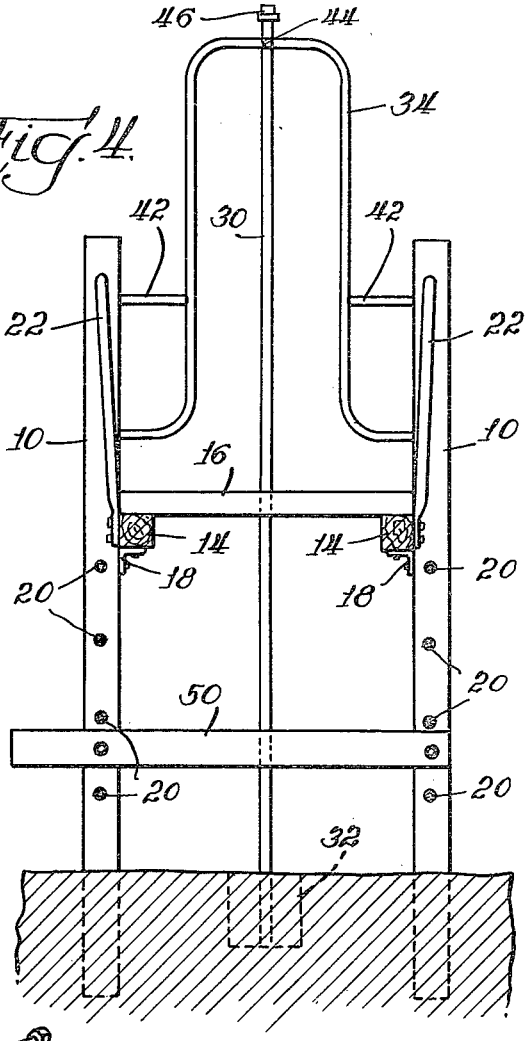
FIG. 4 is a cross-sectional illustration taken at line 4—4 of FIG. 1.

The structure includes a vertical post 10 attached to each corner of a horizontal platform 12. The platform 12 is comprised of a rectangular frame 14 covered by a series of boards 16 which may be nailed or otherwise secured to the frame 14. The frame 14 may be bolted directly to the posts 10, or, as shown in FIGS. 3 and 4, may be mounted upon and bolted to angular brackets 18 which in turn are bolted to the posts 10.

A series of horizontal rungs 20 extend between adjacent posts 10 on opposite sides of the structure, forming ladders to the platform 12. The rungs may be embedded in or appropriately attached to the posts 10, or, as shown in FIG. 3, may pass through the posts and be secured thereto by suitable bolts. To ease access to the platform 12 and to provide additional challenge to a climber, a series of handrails 22 may be used, bolted to the frame 14 and the adjacent vertical post 10.

A slide 24 extends outwardly from the platform 12 and, for permanence, is preferably embedded within a concrete footing 26. Alternatively, and as shown in phantom, an arch climber 28 may be substituted for the slide 24.

Opposite the slide 24 is a vertical pole 30, often referred to as a fireman's pole. For rigidity, the pole 30 is embedded in a concrete footing 32. An arch 34 extends between and rises above two adjacent posts 10 and is connected to the pole 30 by a horizontal bar 36. The arch 34 rises to a sufficient height above the platform 12 to allow a user easy access to the pole 30.

Figure 5:
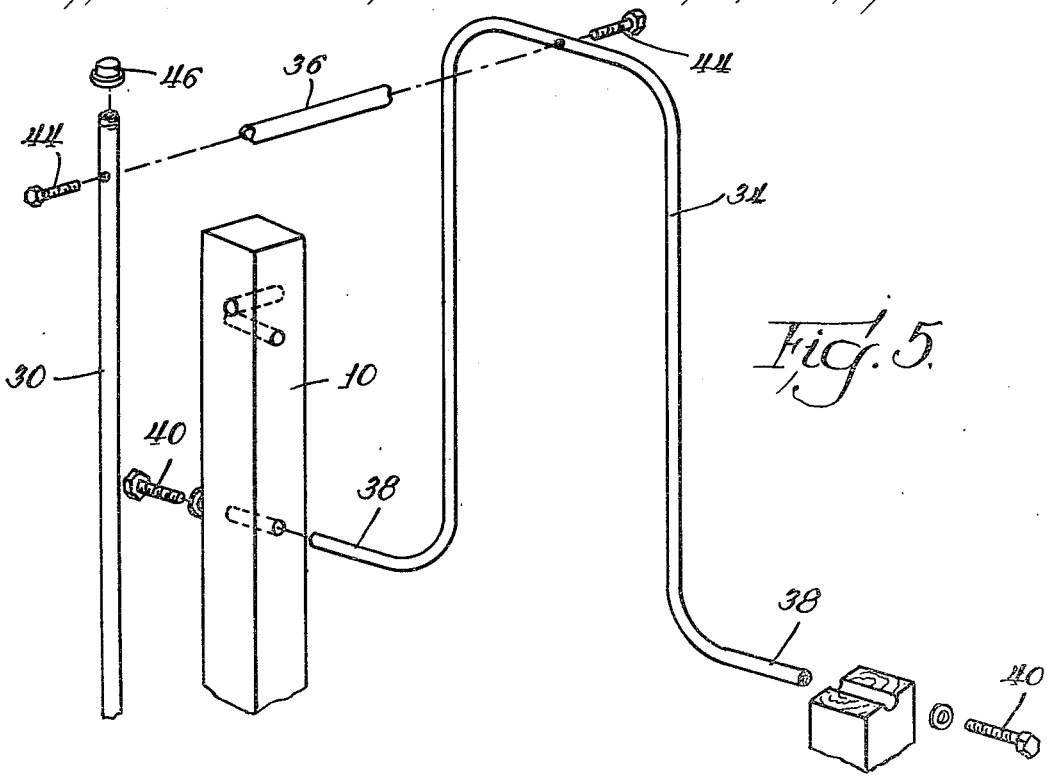
FIG. 5 is an exploded partial illustration of the arch and vertical sliding pole arrangement according to the invention.

The arch 34 includes a pair of base legs 38 extending to an adjacent post 10. As with the rungs 20, the base legs may be embedded or attached to the posts 10, or, as shown in FIG. 5, may pass through the posts and be attached thereto by a suitable bolt 40. For added rigidity and support of the arch 34, a pair of support bars 42 extend between the arch and a corresponding post 10 as shown in FIGS. 3 and 4.

As best shown in FIG. 5, the horizontal connecting bar 36 is preferably attached to the arch 34 and pole 30 by a pair of bolts 44. The vertical pole 30 is topped with a cap 46 to prevent rain from entering the pole and to give the pole a finished look.

As an added safety and attention feature, a horizontal rail 48 may be used above the slide 24, extending between adjacent posts 10. Likewise, to add rigidity to the structure while providing additonal complexity to challenge a child's imagination, one or more horizontal cross bars 50 may be used extending beyond the bounds of the structure to form a step from which a user may climb onto the structure or jump down to the ground.

Since the rungs 20, arch 34, rail 48, and handrails 22 are used for climbing and support, they preferably are made of metal. Similarly, since the pole 30 is to be used for sliding down to the ground from the platform 12, it preferably also is made of metal. The platform 12, posts 10, and cross bars 50 may be formed of four-by-four or six-by-six timbers.

Although the form of the structure is relatively simple in construction, the structure has a multitude of uses which are limited only by the child's imagination. A group of children using the structure at the same time may devise a series of games or tricks sequentially using various portions of the invention, thereby adding to the novelty and challenge of the structure. Because of the wide diversity of possible uses, the structure will remain attractive to children for long periods of time, thus promoting both physical and mental development.

Various changes may be made to the invention to add to its enjoyment. For example, the platform may be expanded in size and additional vertical posts 10 used to support the enlarged platform. If the horizontal rungs 20 are eliminated from one side of the structure, or additional posts 10 added when the horizontal platform is expanded in size, side rails may be added between adjacent posts 10 to add to the safety of the structure and provide an additional climbing incentive to the children using the structure. The form may otherwise be changed to add incentive or challenge the physical prowess of children without departing from the scope of the following claims.

I claim:

1. A child recreation structure comprising a. a horizontal platform for supporting a user of the structure, the platform being situated above the ground and having at least four sides, b. a vertical post attached to each corner of the platform to support the platform, at least two adjacent posts rising above said platform, c. an arch extending between and rising above said two adjacent posts, said arch being unitary and including a pair of base legs which extend generally horizontally outwardly from said arch, each said leg extending to a corresponding one of said two adjacent posts, d. a vertical pole adjacent to and spaced from said platform at said arch and extending above said platform to at least the height of the top of said arch for sliding from said platform to the exterior of said structure, said vertical pole being arranged approximately equidistantly between said two adjacent posts, e. means connecting said vertical pole to the top of said arch, and f. means to allow a user of said structure access to said platform.

2. A child recreation structure according to claim 1 including a rigid support extending between said arch and a corresponding one of said two adjacent posts above each said base leg.

* * * * *